US005276449A

United States Patent [19]

Walsh

[11] Patent Number: 5,276,449

[45] Date of Patent: Jan. 4, 1994

[54] RADAR RETROREFLECTOR WITH POLARIZATION CONTROL

[75] Inventor: John B. Walsh, Bellevue, Wash.

[73] Assignee: The Boeing Company, Seattle, Wash.

[21] Appl. No.: 945,750

[22] Filed: Sept. 16, 1992

[51] Int. Cl.[5] ..... H01Q 21/06

[52] U.S. Cl. ..... 342/5; 342/188; 342/361; 342/370

[58] Field of Search ..... 342/5, 7, 188, 361, 342/370

[56] References Cited

U.S. PATENT DOCUMENTS 3,757,343 9/1973 Bogner ..... 343/770

OTHER PUBLICATIONS

Panasiewicz, J. J., "Enhancement of Aircraft Radar Return by Use of Airborne Reflectors and Circular Polarization", IRE Convention Record, vol. 4, pt. 8, pp. 89-96, 1956.

*Primary Examiner*—T. H. Tubbesing

*Attorney, Agent, or Firm*—Fitch, Even, Tabin & Flannery

[57] ABSTRACT

Disclosed is a method and an apparatus which act as a retroreflector of circularly polarized electromagnetic radiation over a broad range of incident angles. The apparatus includes dipole antenna pairs which are orthogonally disposed in relation to one another about a central point to create antennas which consist, for example, of crossed dipoles but can be other circular polarization sensitive antennas. Antenna pairs are then arranged symmetrically in an array and interconnected by means which control the circular polarization of the returned signals to provide retroreflection of impinging signals while maintaining the same sense of polarization. The array thereby provides enhancement of the radar cross-section of a target when circularly polarized radar is employed. Conversely, the array can be connected so as to enhance opposite-polarization returns should there be any desire to do so.

18 Claims, 3 Drawing Sheets

RADAR RETROREFLECTOR WITH POLARIZATION CONTROL

BACKGROUND OF THE INVENTION

This invention relates to radar retroreflectors, and particularly, to retroreflectors which control the polarization of reflected electromagnetic radiation.

Radar systems detect a "target" such as an aircraft by irradiating an area with electromagnetic radiation from a radar transmitter and analyzing the radiation reflected back to a radar receiver to ascertain the presence of the target. When reflective surfaces other than the target are present, they produce reflected waves called "clutter." Clutter may be caused by many things including weather conditions, such as ice crystals, rain drops, hail stones, etc. When an aircraft is immersed in rain, it is often difficult to discriminate the presence of the aircraft target from the rain clutter.

Circular polarization is sometimes employed in radar systems to distinguish targets from clutter. By transmitting circularly polarized electromagnetic waves and receiving only waves having the same sense of circular polarization (clockwise or counterclockwise) as the transmitted wave, it is possible to suppress reflections caused by rain clutter. This is accomplished by using receiving equipment which is sensitive only to waves having the same sense of polarization as that of the transmitted wave and insensitive to waves having the opposite sense of polarization.

It is well understood in the art that radiation reflected from rain clutter will have a reverse sense of circular polarization. In contrast, a target such as an aircraft will reflect substantial radiation having the same sense of circular polarization as the transmitted waves. Circularly polarized waves reflected by rain clutter are received having a sense of polarization which is opposite to the sense of polarization of the transmitted waves. However, a substantial portion of circularly polarized waves reflected from targets is received having the same sense of polarization as the transmitted waves. Thus, suppression of rain clutter is accomplished by rejecting waves having a reverse sense of polarization from the transmitted waves.

The same-sense radar return from most perspectives of an aircraft is acceptable for use with a radar system employing circular polarization to discriminate targets from clutter. Even though an aircraft is a complex target with many equivalent corners, circularly polarized waves doubly bounced from corners will return with the same sense of polarization, so aircraft returns typically undergo but little suppression. However, viewed nose-on the same-sense radar return from an aircraft is weak, therefore it is desirable to enhance this return.

One known way of enhancing the cross-section of a target is by the use of a retroreflector. A retroreflector is an apparatus which receives an electromagnetic radiation wave from a source and returns the received wave back toward the source. A corner reflector which resembles a corner cut off from a cube is one type of retroreflector. In general, electromagnetic radiation incident on such a corner reflector bounces three times and is reflected back substantially in the opposite direction to the direction of arrival. Retroreflection takes place with a corner reflector over a broad range of incident angles so that the corner reflector does not have to be aligned with the source. The reflection from a circularly polarized incoming radar wave, however, will be polarized in the opposite sense to that transmitted since it will have been reflected three times within the corner. Thus, a rain rejection radar which rejects oppositely polarized waves will also reject waves reflected from a corner reflector.

A dipole antenna can also be used to return an enhanced reflection wave. However, if circular polarization is employed, only half of the returned radiation will have the same sense of polarization. Also, the returned radiation from a dipole is not retroreflected, but scattered in nearly all directions.

Retroreflection can be achieved by arranging a group of dipoles in a conventional linear or planar van-Atta array configuration to concentrate the return energy back towards the source. The conventional van-Atta array works well with waves polarized in a single plane. But circularly polarized waves retroreflected from a van-Atta array will have only half of the reflected radiation polarized in the same sense as the impinging radiation. Thus, the conventional van-Atta array may provide less enhancement than is desired.

A need exists for a method and an apparatus for enhancing the radar cross-section of a target to circularly polarized radar waves which provide retroreflection while at the same time controlling the sense of circular polarization of the returned waves, so rain clutter suppression can be used effectively.

SUMMARY OF THE INVENTION

An arrangement in accordance with the present invention includes circular polarization sensitive antennas which are connected in pairs to retroreflect circularly polarized waves having a controlled sense of circular polarization with respect to impinging waves from a radar source. The pairs of antennas can be disposed in arrays which act as a retroreflector of circularly polarized electromagnetic radiation over a broad range of incident angles. Such an array provides enhanced target radar return while suppressing rain clutter.

One embodiment of the invention utilizes dipole antennas which are orthogonally disposed in relation to one another about a central point to create circular polarization sensitive antennas consisting of crossed dipoles. Since each dipole is sensitive to one of the orthogonal components of a circularly polarized electromagnetic signal, the crossed-dipole antennas are used to receive and transmit circularly polarized electromagnetic radiation. Pairs of antennas are coupled together by equal length conductors or other transmission line medium for conveying electrical signals with equal time delay. The antenna pairs can be arranged symmetrically in a linear or plane array.

In this configuration, an array in accordance with the present invention is similar to that of the van-Atta array; however, the array of the present invention returns circularly polarized waves. The interconnection patterns of the antennas of each connected pair determines the polarization sense of the returned radiation. For example, the array may be fabricated to return a circularly polarized signal only in the same sense of rotation as an impinging signal, thereby providing retroreflection of the impinging signal while maintaining the same sense of polarization. Thus, the array of the present invention can provide enhancement of the radar cross-section of a target to circularly polarized radar signals. An aircraft equipped with such an array will stand out prominently on radar designed to reject rain clutter even when viewed from the nose-on perspective.

The various other aspects of the present invention will become readily apparent to those skilled in the art in a radar wave retroreflecting apparatus and a method of increasing the radar cross-section of a target. The radar wave retroreflecting apparatus reflects circularly polarized electromagnetic waves transmitted from a source back toward the source. The retroreflector comprises means for receiving the electromagnetic waves circularly polarized in a first sense and means for conveying from the receiving means to a retransmitting means electrical signals representing the electromagnetic waves received by the receiving means. The retransmitting means is responsive to the electrical signals from the conveying means for transmitting circularly polarized electromagnetic waves substantially toward the source. The method of increasing the radar cross-section of a target comprises equipping the target with a radar wave retroreflecting apparatus, transmitting radar waves circularly polarized in a first sense from a source location to the target, receiving the radar waves by the retroreflecting apparatus, and reradiating radar waves from the retroreflecting apparatus to the source location in response to the receiving step, the reradiated radar waves being circularly polarized in the first sense and directed toward the source location. Also disclosed is a radar wave retroreflecting antenna array comprising an even plurality of circular polarization sensitive antennas disposed substantially in a plane, and means for coupling pairs of the antennas such that the excitation of one antenna of each coupled pair of antennas by an incoming radar wave circularly polarized in a first sense and arriving in a first direction causes the other antenna connected thereto to radiate outgoing radar waves circularly polarized in the first sense and in a second direction substantially opposite to the first direction.

DETAILED DESCRIPTION OF THE PREFERRED EMBODIMENT

Figure 1:
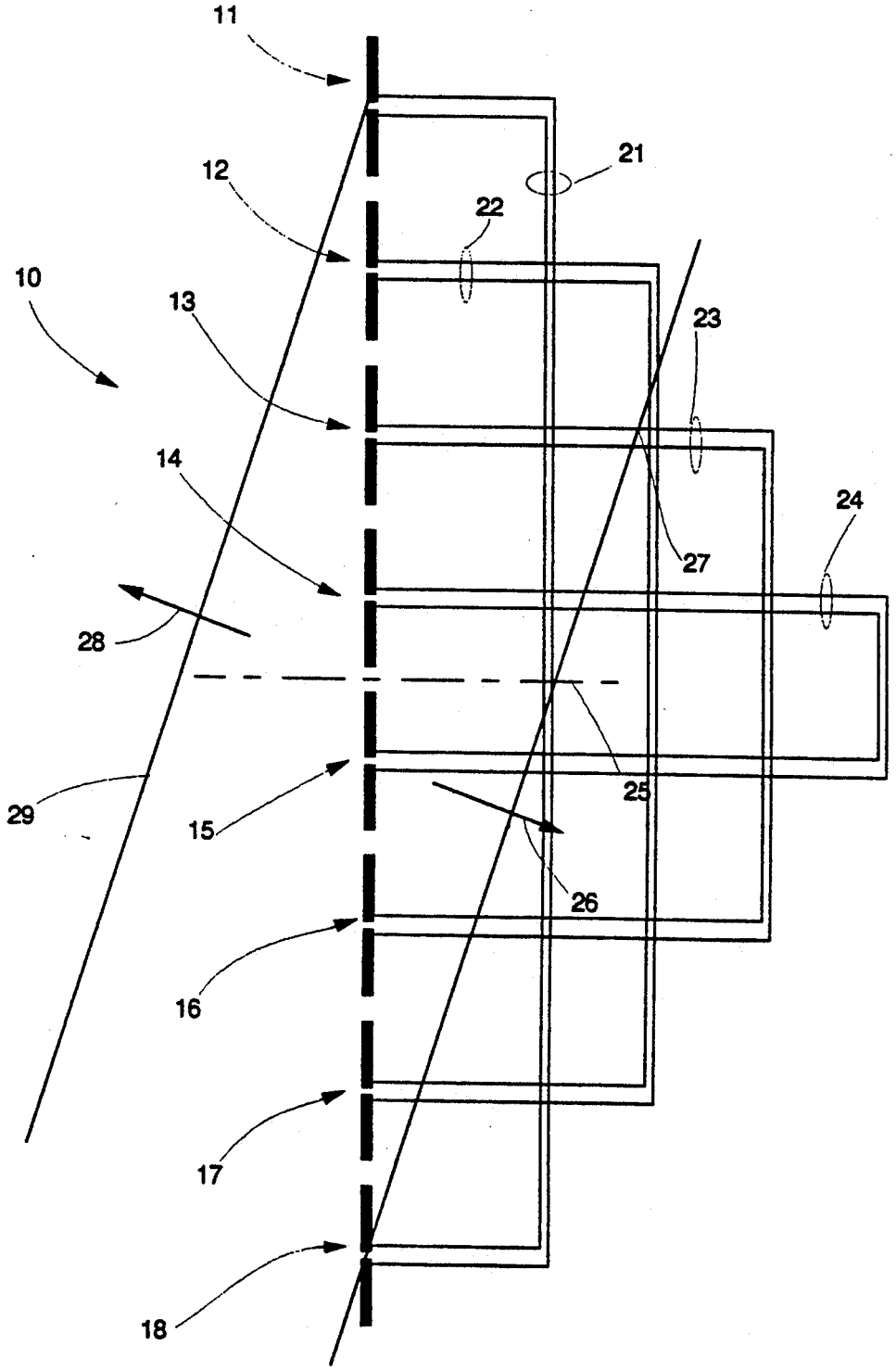
FIG. 1 is a schematic drawing of a conventional linear van-Atta array.

FIG. 1 shows a conventional linear van-Atta array 10. The array 10 consists of dipole antennas 11–18 which are arranged to return a wave front 29 in a direction substantially opposite the direction of an impinging wave front 27. The eight dipole antennas 11–18 are interconnected in pairs symmetric about a center line 25, and equidistant from the center line 25. While a single dipole returns a weak signal that is radiated in nearly all directions, the group of dipoles 11–18 arranged in array 10 returns a concentrated signal. Thus, the array 10 acts as a retroreflector.

FIG. 1 shows the wave front 27 having a direction of propagation denoted by an arrow 26. The wave front 27 is impinging on the array 10. As a result of receiving wave front 27, the array 10 transmits the wave front 29 having a direction of propagation denoted by an arrow 28—substantially opposite to the wave front 27.

In FIG. 1, each antenna e.g., 11 is connected by a pair of conductors e.g., 21 to one antenna e.g., 18 on the opposite side of center line 25. The conductor pairs 21–24 can be any appropriate kind of transmission line or waveguide depending on the application. In the present example, antenna 12 is connected to antenna 17 by conductor pair 22; antenna 13 is connected to antenna 16 by conductor 23; and antenna 14 is connected to antenna 15 by conductor pair 24.

When a dipole antenna such as antenna 11 is excited by (receives) the incoming wave front 27, electrical signals are conveyed via conductor pair 21 to connected antenna 18. These electrical signals which are delayed for a time period $\Delta t$ determined by the type of conductors and their length, will excite antenna 18 to radiate a representation of the radiation received at antenna 11. Radiation from antenna 18 will occur at a time approximately $\Delta t$ after an incoming signal was received by antenna 11. In the present example, all of the conductor pairs 21–24 provide the same delay period $\Delta t$. This is usually accomplished by making all of the conductor pairs 21–24 of equal length from the same medium.

FIG. 1 illustrates the incoming wave front 27 exciting antennas 11 through 18 in sequence from top to bottom. At a period of time, $\Delta t$ after each antenna 11–18 is excited by the incoming wave front 27, each connected antenna 18–11 respectively is excited by signals conveyed over one of the conductor pairs 21–24 to launch outgoing wave front 29. The antennas 18–11 each start radiating in reverse numerical sequence—antenna 18 through antenna 11 successively—thereby producing the wave front 29.

It should be noted that as the incident wave front 27 moves across the array 10, it eventually excites antennas 15 through 18 which had previously retransmitted signals received by antennas 11 through 14. Signals responsive to electromagnetic waves received by antennas 15–18 pass through the conductor pairs 21–24 in a direction opposite to the signals which were responsive to waves previously received by antennas 11–14. Moreover, it should be noted that each antenna 11–18 acts both as a receiving antenna and as a transmitting antenna.

This description characterizes the basic operating principles of the array 10. One skilled in the art will readily recognize that spurious reflections which occur in practice may also have to be considered depending on the particular application. Also, the surface on which the antennas 11–18 reside can be either a conducting or absorbing material, depending on the application, but this is not important to the basic operation of the array 10.

The linear dipole array 10 of FIG. 1 operates effectively as a radar retroreflector when wave front 27 is polarized in a single plane. However, when the incoming wave front 27 is circularly polarized, only half of the reflected outgoing wave front 29 will have the same sense of circular polarization and the other half will have the opposite sense of polarization. Accordingly, a more desirable retroreflector for circularly polarized electromagnetic radiation is desired.

Figure 4A:
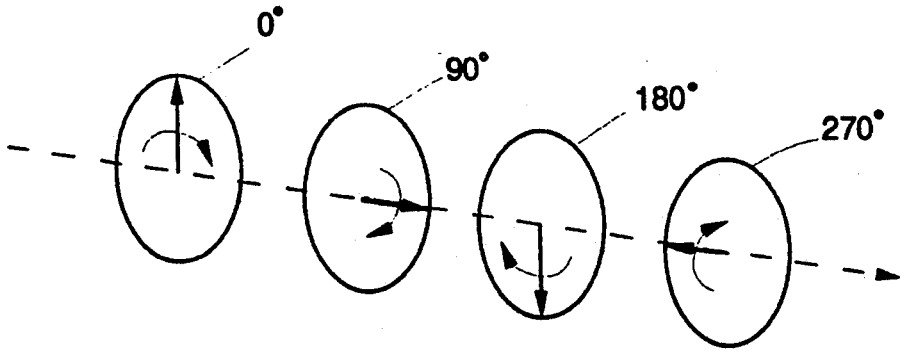
FIGS. 4*a* and 4*b* represent the direction of a clockwise and counterclockwise sense of circular polarization, respectively, viewed from a transmitting antenna; (time progresses from left to right)
Figure 4B:
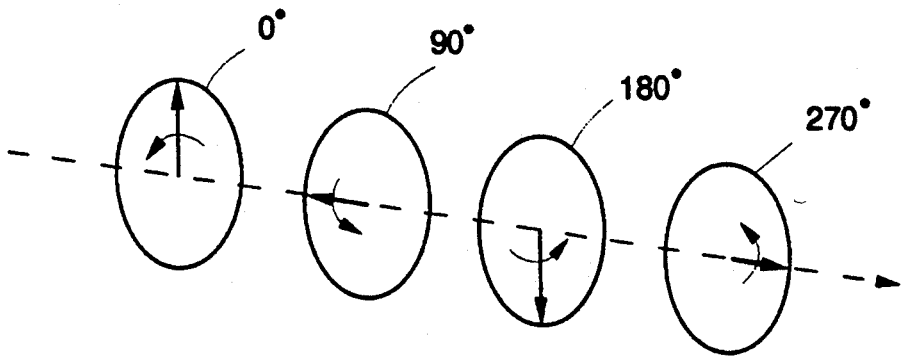

A circularly polarized wave is one in which the polarization direction rotates with a fixed period of time. Thus, the polarization of the wave does not reside in a single plane. The sense of rotation can be either clockwise or counterclockwise (or alternatively left-handed or right-handed) when viewed from a reference point. The reference point can be either the transmitting end or the receiving end; it is customary to view the wave from the direction from which it is traveling. FIGS. 4*a* and 4*b* represent successive 90° "snap shots" of equal time spacing to show the direction of polarization of a clockwise and counterclockwise circularly polarized wave respectively when viewed from a transmitting antenna.

Figure 2:
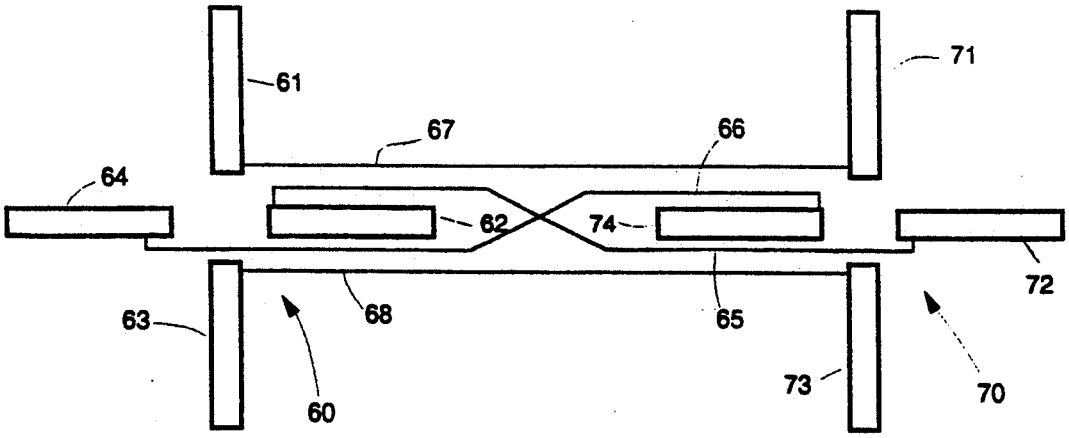
FIG. 2 shows a pair of crossed-dipole antennas coupled by transmission lines, such that circularly polarized waves received at one antenna are transmitted by the other antenna with an opposite sense of polarization.

FIG. 2 represents two circular polarization sensitive antennas 60 and 70 and their interconnection. Antenna 60 is a crossed dipole antenna fabricated from dipole elements 61, 63 and 62, 64 which receive circularly polarized electromagnetic radiation (of either sense) and produce responsive signals on conductors 65 through 68 representing the received radiation. The dipoles are each fed separately at two separate ports e.g., at conductor pair 65, 66 interface with dipole elements 62, 64 and at conductor pair 67, 68 interface with dipole elements 61, 63. Arrangements, widely known in the art, can be made to minimize cross-coupling between the two ports.

FIG. 2 also shows a second crossed-dipole antenna 70 which is substantially identical to antenna 60 and is excited by the electrical signals on conductors 65 through 68. More specifically, dipole element 61 is connected to dipole element 71 of antenna 70 via conductor 67; dipole element 62 is connected to dipole element 72 via conductor 65; dipole element 63 is connected to dipole element 73 via conductor 68, and dipole element 64 is connected to dipole element 74 via conductor 66. The orthogonally disposed crossed-dipole antennas illustrated in FIG. 2 are sensitive to circular polarized electromagnetic radiation, because each dipole is sensitive to one of the orthogonal components of a circularly polarized wave.

Exciting antenna 60 with a circularly polarized wave travelling into the page creates signals on conductors 65 through 68 which cause antenna 70 to radiate a circularly polarized wave travelling out of the page. It should be noted that with the configuration shown in FIG. 2, the sense of the circular polarization of waves radiated from antenna 70 is opposite to the waves received by antenna 60. Moreover, the waves radiated from antenna 70 will have a sense of polarization which is opposite to waves reflected from a target. The reversed sense of polarization of reflected radiation would be ignored by rain clutter suppressing receivers.

Figure 3:
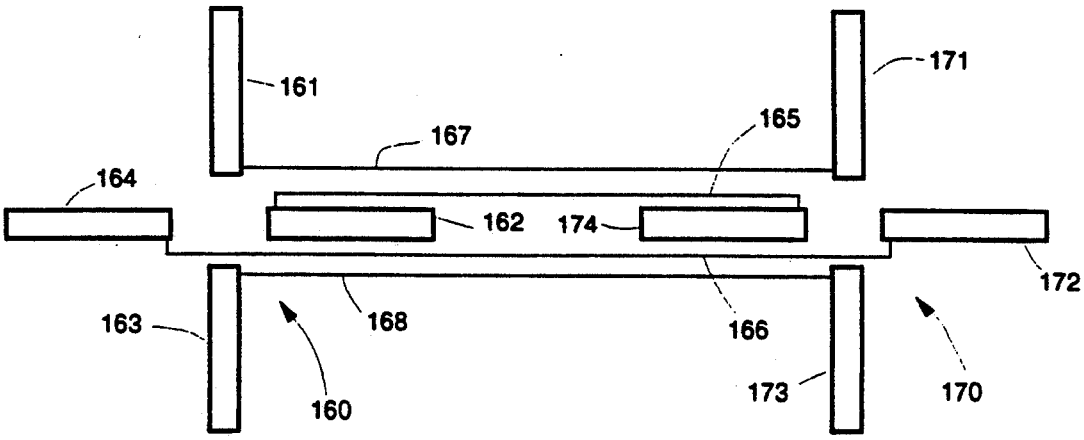
FIG. 3 shows a pair of crossed-dipole antennas coupled by transmission lines, such that circularly polarized waves received by one antenna are transmitted by the other antenna with the same sense of polarization.

FIG. 3 shows a pair of antennas 160 and 170, each of which is substantially identical to the antennas 60 and 70 respectively of FIG. 2. The interconnection of antennas 160 and 170, however, is different from the interconnection of antennas 60 and 70. In FIG. 3, dipole element 161 is connected to dipole element 171, via a conductor 167; dipole element 162 is connected to dipole element 174 via a conductor 165; dipole element 163 is connected to dipole element 173 via a conductor 168; and dipole element 164 is connected to dipole element 172 via a conductor 166. It is important to note that the coupling between antennas 160 and 170 in FIG. 3 reverses the interconnection of dipole elements 162, 164, and 172, 174 relative to the interconnection of dipole elements 62, 64, and 72, 74 of antennas 60 and 70 in FIG. 2.

Due to the interconnection of dipole elements 162, 164 and 174, 172 shown in FIG. 3, exciting antenna 160 with a clockwise polarized wave causes a clockwise polarized wave to be radiated from antenna 170. Thus, the sense of the circular polarization of waves radiated from antenna 170 is the same as the waves received by antenna 160. It should be further noted that an alternative reverse interconnection of the other dipole elements 161, 163, and 173, 171 will also cause the circular polarization of waves radiated from antenna 170 to be the same as the waves received by antenna 160. So, this would provide an equally desirable coupling between antennas 160 and 170.

When the delay provided by conductors 165 through 168 is equal to $\Delta t$, the wave radiated from antenna 170 will follow the wave received by antenna 160 at the time $\Delta t$ before radiation. Should the antennas of FIG. 3 be substituted for the antenna pairs of FIG. 1, the sense of polarization of retroreflected radiation would be the same as the received radiation and thus acceptable for use with rain clutter suppressing receivers.

Figure 5:
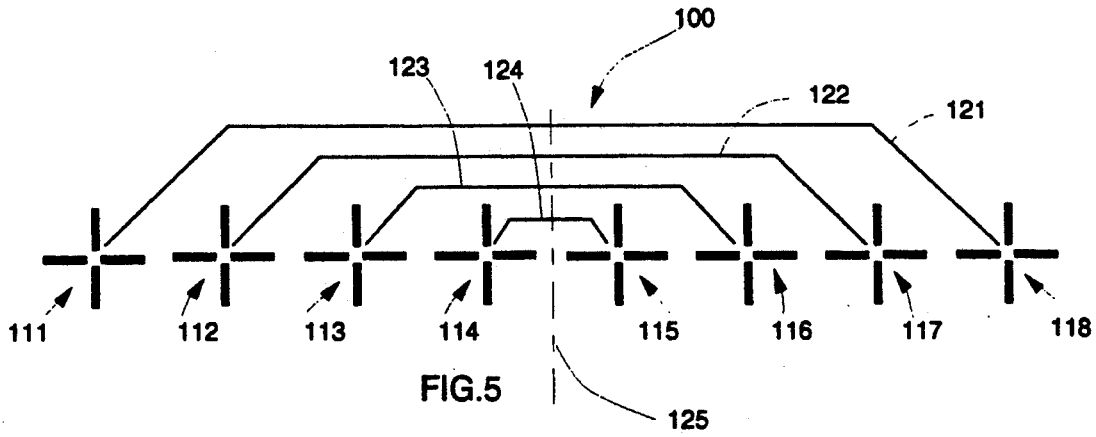
FIG. 5 is a schematic diagram of a linear array according to the invention.

FIG. 5 shows a linear array 100 of circular polarization sensitive antennas 111 through 118 of the type shown in FIG. 3. The antennas 111 through 118 of the array are connected in pairs so that antennas equidistant on opposite sides of a center line 125 are connected, each connected pair of antennas e.g. 111, 118 is connected in the manner of FIG. 3 so that the sense of polarization is maintained when the retroreflected wave is radiated by the array. Further, each of the intra-antenna connections 121 through 124 provides the same time delay $\Delta t$ from signal reception at one antenna to responsive radiation by the antenna connected thereto.

The arrangement of the antennas 111–118 and the equal delay time $\Delta t$ for signals coupled through each connection 121–124 in the array 100 provides retroreflection properties. Also, the sense of polarization is maintained by connecting the pairs of antennas in the manner described in FIG. 3. Thus, as a result of receiving circularly polarized radiation, the array 100 transmits circularly polarized radiation having a direction of propagation substantially opposite to the received radiation and the same sense of polarization as the received radiation.

Figure 6:
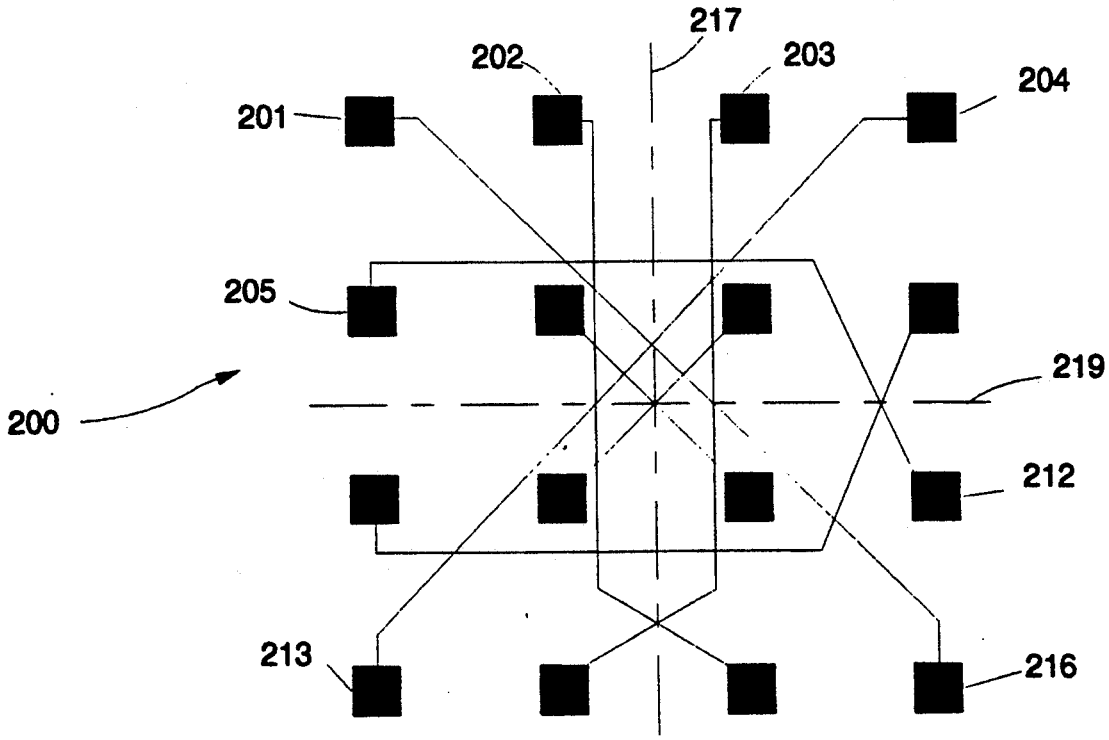
FIG. 6 is a plan view of a two-dimensional plane array of 16 antenna elements.

The principles of the present invention can also be applied to two-dimensional antenna arrays to increase radar cross-section and enhance radar return from targets. FIG. 6 is a plan view of a two-dimensional square array 200 of sixteen antennas representative ones of which have been numbered 201–205, 212, 213 and 216. The antennas e.g., 201 which are represented by black squares are circular polarization sensitive antennas and are connected in the manner shown in FIG. 3 to preserve the sense of impinging circularly polarized signals.

Two orthogonal axis lines 217 and 219 which cross substantially at the center of the array 200 are also shown in FIG. 6. In order to preserve the retroreflector capability for a plane wave front, each antenna e.g., 201 positioned at a given distance from both of the axis lines 217 and 219 is connected to an opposing antenna e.g., 216 having equal distances on the opposite side of each axis line 217 and 219. Thus, symmetry exists with respect to a point of symmetry located at the center of the array 200—where axis line 217 crosses with axis line 219. For example, antenna 201 which is two positions to the left of axis line 217 and two positions above axis line 219 is connected to antenna 216 which is two positions to the right of axis line 217 and two positions beneath axis line 219. Similarly, antenna 205 which is one position above axis line 219 and two positions to the left of axis line 217 is connected to antenna 212 which is one position below axis line 219 and two positions to the right of axis line 217.

As in the previous examples, the delay provided by the connections from one antenna of a coupled pair to the other is the same for all connected antenna pairs in array 200, irrespective of whether the antennas are physically close or far from one another. Accordingly, the array 200 will act as a retroreflector which preserves the sense of incoming circularly polarized radiation, thereby enhancing detection of the target in a rain clutter suppression radar system.

While there have been illustrated and described particular embodiments of the present invention, it will be appreciated that numerous changes and modifications, which fall within the true scope of the present invention, will occur to those skilled in the art. In actual implementation it is not necessary to use crossed-dipole antenna pairs having two separate ports. For example, the antenna pairs could be replaced by a circularly polarization sensitive single port antenna and its mirror image for receiving and transmitting combined circularly polarized signals. Accordingly, the scope of the present invention should be defined only by the appended claims and the equivalents thereof.

What is claimed is:

1. A radar wave retroreflecting apparatus for reflecting circularly polarized electromagnetic waves transmitted from a source back toward said source, said apparatus comprising:

means for receiving said electromagnetic waves circularly polarized in a first sense;

means for conveying from said receiving means to a transmitting means electrical signals representing the electromagnetic waves received by said receiving means;

said conveying means comprising means for delaying said electrical signals representing electromagnetic waves received by said receiving means a predetermined period of time before transmission from said receiving means; and said transmitting means being responsive to said electrical signals from said conveying means for transmitting substantially toward said source circularly polarized electromagnetic waves.

2. A radar wave retroreflecting apparatus according to claim 1 wherein said conveying means comprises a transmission medium for conveying from said receiving means to said transmitting means said electrical signals representing the electromagnetic waves circularly polarized in said first sense.

3. A radar wave retroreflecting apparatus according to claim 1 wherein said conveying means comprises a transmission medium for conveying from said receiving means to said transmitting means said electrical signals representing the electromagnetic waves circularly polarized in a second sense opposite to said first sense.

4. An apparatus according to claim 1 wherein said transmitting means and said receiving means both receive and transmit circularly polarized electromagnetic waves; and said conveying means further comprises means for conveying from said transmitting means to said receiving means electrical signals representing the electromagnetic waves received by said transmitting means, whereby electromagnetic waves incident upon said receiving means are transmitted by said transmitting means and electromagnetic waves incident upon said transmitting means are transmitted by said receiving means.

5. An apparatus according to claim 1 wherein:

said receiving means comprises a first dipole antenna and a second dipole antenna orthogonally disposed in relation to one another about a first central point;

said transmitting means comprises a third dipole antenna and a fourth dipole antenna orthogonally disposed in relation to one another about a second central point; and said conveying means comprises means for conveying said signals from said first dipole antenna to said third dipole antenna such that said third dipole antenna transmits electromagnetic waves circularly polarized in said first sense.

6. An apparatus according to claim 1 wherein:

said receiving means comprises a first dipole antenna and a second dipole antenna orthogonally disposed in relation to one another about a first central point;

said transmitting means comprises a third dipole antenna and a fourth dipole antenna orthogonally disposed in relation to one another about a second central point; and said conveying means comprises means for conveying said signals from said first dipole antenna to said third dipole antenna such that said third dipole antenna transmits electromagnetic waves circularly polarized in a second sense opposite to said first sense.

7. An apparatus according to claim 1 wherein:

said receiving means comprises a first single port antenna sensitive to electromagnetic waves circularly polarized in a first sense; and said transmitting means comprises a second single port antenna sensitive to electromagnetic waves circular polarized in a second sense, said second antenna being the mirror image of said first antenna.

8. A method of increasing the radar cross-section of a target, said method comprising the steps of:

equipping said target with an antenna pair comprising a first circularly polarized antenna coupled to a second circularly polarized antenna;

transmitting first radar waves circularly polarized in a first sense from a source location to said target;

receiving said first radar waves by said antenna pair; and radiating second radar waves from said antenna pair to said source location in response to said receiving step, said second radar waves being circularly polarized in said first sense and directed toward said source location.

9. A method in accordance with claim 8, wherein said equipping step comprises:

equipping said target with an antenna pair comprising a first crossed dipole antenna coupled to a second crossed dipole antenna, each crossed dipole antenna of said antenna pair being a pair of dipoles orthogonally disposed in relation to one another.

10. A radar wave retroreflecting antenna array comprising:

an even plurality of circular polarization sensitive antennas disposed substantially in a plane; and means for coupling pairs of said antennas such that the excitation of one antenna of each coupled pair of antennas by an incoming radar wave circularly polarized in a first sense and arriving in a first direction causes the antenna connected thereto to radiate outgoing radar waves circularly polarized in said first sense and in a second direction substantially opposite to said first direction.

11. An antenna array in accordance with claim 10 wherein the antennas of said plurality of antennas are symmetrically disposed about a central point and said coupling means comprises means for coupling antennas which are equidistant from said central point.

12. An antenna array in accordance with claim 11 wherein each pair of antennas coupled by said coupling means comprise first antenna comprising a first dipole antenna and a second dipole antenna orthogonally disposed in relation to one another about a first central point and a second antenna comprising a third dipole antenna and a fourth dipole antenna orthogonally disposed in relation to one another about a second central point; and said coupling means comprises means for conveying electrical signals representing the electromagnetic waves received by said first dipole antenna from said first dipole antenna to said third dipole antenna and from said second dipole antenna to said fourth dipole antenna.

13. An antenna array in accordance with claim 12 wherein said coupling means comprises means for conveying electrical signals representing the electromagnetic waves received by said first dipole antenna from said first dipole antenna to said third dipole antenna in said first sense and from said second dipole antenna to said fourth dipole antenna in said first sense.

14. An antenna array in accordance with claim 12 wherein said coupling means comprises means for conveying electrical signals representing the electromagnetic waves received by said first dipole antenna from said first dipole antenna to said third dipole antenna in a second sense opposite to said first sense and from said second dipole to said fourth dipole in said first sense.

15. An antenna array in accordance with claim 11, wherein said coupling means comprises a plurality of conductors for each coupled pair of antennas, each said plurality of coupling conductors being coupled to a pair of antennas for conveying an electrical signal generated by the receipt of said incoming radar wave by one antenna of a coupled pair of antennas to the other antenna of the coupled pair of antennas.

16. An antenna array in accordance with claim 15, wherein each of said plurality of conductors comprises means for delaying the electrical signals to provide a predetermined period of time between receipt of said incoming radar wave by one antenna of a connected pair of antennas and the application of said electrical signal to the other antenna of a connected pair of antennas.

17. An antenna array in accordance with claim 10, wherein the antennas of said plurality of antennas are disposed along a line with equal spacing between adjacent antennas; and said coupling means comprises means for coupling antennas which are equidistant from a central point along said line.

18. An antenna array in accordance with claim 17, wherein said coupling means comprises delay means for causing radiation by an antenna a predetermined period of time after the excitation by a radar wave of the antenna coupled thereto.

* * * * *